United States Patent [19]

Toncelli

[11] Patent Number: 5,022,193

[45] **Date of Patent: * Jun. 11, 1991**

[54] METHOD OF AUTOMATICALLY GAUGING ARTICLES OF GRANITE, HARD STONES AND THE LIKE OF DISIRED THICKNESS, WITH DISCONTINUOUS MOTION

[75] Inventor: Luca Toncelli, Bassano del Grappa, Italy

[73] Assignee: Breton S.P.A., Treviso, Italy

[ * ] Notice: The portion of the term of this patent subsequent to Apr. 10, 2007 has been disclaimed.

[21] Appl. No.: 489,268

[22] Filed: Mar. 6, 1990

Related U.S. Application Data

[63] Continuation of Ser. No. 239,782, Sep. 2, 1988, abandoned.

[30] Foreign Application Priority Data

Sep. 15, 1987 [IT] Italy ..... 85599 A/87

[51] Int. Cl.[5] ..... B24B 7/06

[52] U.S. Cl. ..... 51/283 R

[58] Field of Search ..... 51/34 C, 35, 38, 39, 51/45, 56 R, 283 R; 125/2, 3, 4, 5, 8, 9

[56] References Cited

U.S. PATENT DOCUMENTS 4,914,870 4/1980 Toncelli ..... 51/283 R

*Primary Examiner*—Frederick R. Schmidt
*Assistant Examiner*—Blynn Shideler
*Attorney, Agent, or Firm*—Bucknam and Archer

[57] ABSTRACT

Manufactured articles of granite, hard stone with a gauged thickness, uniform surface free of defects are obtained by a method which provides for discontinuous advance of the article along a belt, and only when the article is still, the chuck which carries the diamond covered tool performs its transversal motion. An increase in production is achieved.

1 Claim, 1 Drawing Sheet

METHOD OF AUTOMATICALLY GAUGING ARTICLES OF GRANITE, HARD STONES AND THE LIKE OF DISIRED THICKNESS, WITH DISCONTINUOUS MOTION

This is a continuation of application Ser. No. 239,782, filed Sept. 2, 19888, now abandoned.

The present invention relates to granite or other hard stones and more specifically it relates to a process for the production of granite or other hard stones automatically gauged according to a pre-determined thickness, and in a continuous fashion for the purpose of obtaining a uniform product.

According to the present state of the art, several methods are known to obtain manufactured articles of uniform thickness, but all the methods require the utilization of automatic apparatuses having a belt which advances continuously.

The first known method consists of utilizing an automatic apparatus with a belt, the apparatus having one or more gauging chucks. Each gauging chuck is made of a plurality of conical diamond covered tools which are radially disposed with respect to the axis of the chuck. The conical diamond covered tools, each one rotating around its axis of revolution, are connected among themselves by a support structure which in turn is provided with a rotating motion around the axis of the chuck. The material being transported on the belt advances with a constant speed. The gauging operation obtained according to this method permits to obtain calibrated surfaces which however vary according to the parameters of the work. The parameters are the speed of the material being transported, the rate of rotation of the conical diamond covered tools and the rate of the rotation of the support structure. The greater are these parameters, the greater is the probability that vibrations occur which affect the outcome of the gauging operation. In order to carry out this method, in addition, it is necessary to utilize very expensive apparatuses.

Another known method of operation consists of using an automatic machine with a belt, the machine comprising a chuck carrying the tool, the tool having a diamond covered roller, the axis of rotation of the roller being placed transversally with respect to the direction of advance of the material. The tool with the diamond covered roller rotates around its axis of revolution, thus exerting on the article a peripheral force. During the operation the tool is subjected to be damaged only along the generatrix involved by the article. If one increases the width of the material being worked, it is necessary to substitute the diamond covered tool. However, the surface being worked on presents no defects. This method has overcome the drawback of the irregular damage of the tool because it imparts to the tool a transversal motion with respect to the advance of the material. It follows, however, that while one guarantees a constant damage of the tool, one obtains a surface with a great number of defects, surface roughness due to the vibrations which occur during the working operation.

Still another method provides that the chuck which carries the tool be placed with the axis parallel to the direction of the advance of the article. The chuck which carries the tool further is provided with a transversal motion with respect to the discretion of advance of the material. However, also with this method a surface full of defects and great roughness is obtained.

The process according to the present invention permits to overcome the drawbacks mentioned hereinabove and to obtain manufactured articles which are gauged according to the desired thickness and which have a uniform surface free from defects and smooth. Another object of the present invention is to obtain the calibrated articles without substituting the diamond covered tools according to the variation in the width of the article.

Still another object of the present invention is to provide a method which permits to reduce the damage to the same tools, thus limiting the operation cost and which permits to use apparatuses simple to assemble and of limited cost.

The method according to the present invention consists of using a calibrating machine having a belt on which the chuck which carries the tool is disposed with the axis parallel to the direction of the advance of the article. The chuck which carries the tool further is provided with a motion which is transversal with respect to the direction of the advance of the article, which is made to advance in discontinuous fashion. The article is kept still in a position while the tool performs its transverse motion. During its motion the tool which has an adequate width, for instance 100 mm, carries out the gauging operation on a band of width equal to the same tool. After the tool has traveled along the entire width of the article, an electromechanical device provides for the advance of the belt and of the material located on the belt of an amount equal to the width of the tool.

Simultaneously, the tool inverts its advance motion, but not necessarily the motion of rotation. The tool then will carry out the gauging action on a band parallel to the band which had been worked on previously. In this manner, the article, after the operation is carried out, presents a uniform thickness and a smooth surface along the entire length in addition to being free of every defect. This result may be achieved only due to the fact that the gauging operation occur while the article remains still.

The production in accordance with the present invention, despite the fact that the article advances discontinuously, is improved over the prior art in view of the fact that the average speed of the article increases. The method according to the present invention may also be carried out utilizing a calibrating apparatus provided with a chuck carring the tool having the axis of rotation of the tool orthogonal with respect to the plane of advance of the article.

The chuck which carries the tool, however, is always provided with transversal motion with respect to the direction of the advance of the article. Also in this case by providing for the belt to advance discontinuously, the gauging is carried out while the article remains still, thus obtaining an article of uniform thickness and still having a smooth surface which is free of every defect.

The device for controlling the motion of advance of the belt utilized in order to carry out the method according to the present invention, may be of mechanical or electronic type without departing from the scope of the invention.

For a better understanding of the invention reference is being made to the accompanying drawings of which:

Figure 1:
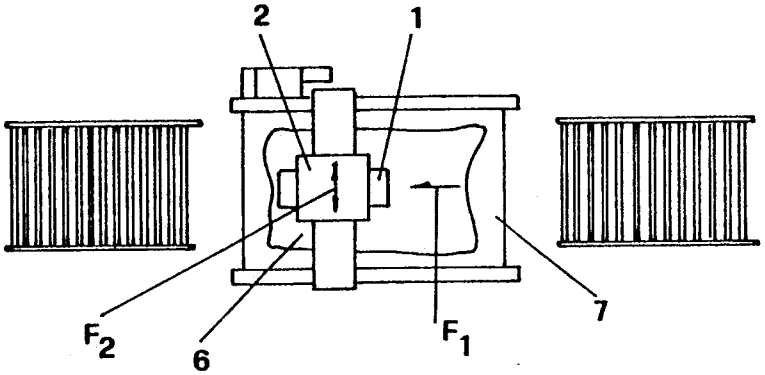
FIG. 1 is an overall view of the apparatus according to the present invention with a continuous belt provided with a tool having the axis of rotation parallel to the direction of the advance of the article and provided with a transversal motion with respect to the same, used for carrying out the method of invention.

FIG. 1 shows that the apparatus comprises a diamond covered tool 1 having the axis of rotation parallel to the direction of advance $F_1$ of the article 6 which is transported by the belt 7 and supported by chuck 2, which is provided with a transversal motion in accordance with the double arrow $F_2$.

Figure 2:
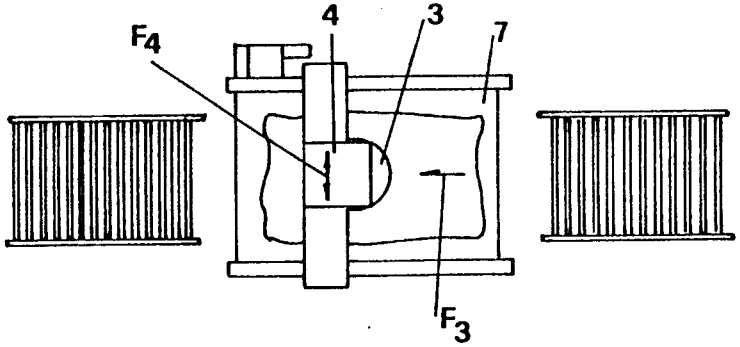
FIG. 2 is an overall view of the apparatus having a continuous belt provided with a tool having the axis of rotation orthogonal with respect to the plane of advance of the material and provided with transversal motion with respect to the same used for carrying out the method according to the present invention.

FIG. 2 shows another embodiment of the apparatus which may be used according to the present invention. The diamond covered tool 3 has the axis of rotation orthogonally with respect to the plane of advance of the article $F_3$. The tool 3 is supported by chuck 4 which carries the tool and which is provided with a transversal motion according to the direction of the double arrow $F_4$.

Figure 3:
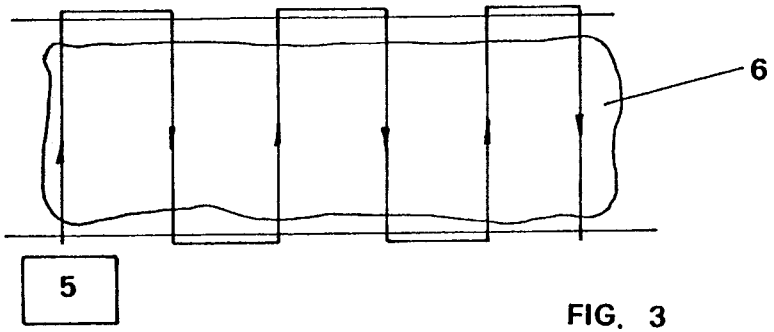
FIG. 3 Illustrates the fret shaped path of travel resulting during the various phases of operation.

FIG. 3 illustrates schematically the path of travel of article 6 carried out by the diamond covered tool 5 which results in a fret shape. In this manner, it is possible to obtain a uniform gauge on the surface of the material which in addition is obtained free from defects. Obviously, the apparatus used in accordance with the present invention has been described herein for the purpose of illustration and is not intended to be limited because different types of chucks may be used to carry the tools without departing from the scope of the invention.

What is claimed is:

1. In a method of gauging a slab of granite or hard stone by advancing said slab on a conveyor belt and subjecting said slab to a chuck carrying a diamond covered tool, said chuck being capable of inverting the direction of its motion, said tool carrying out a transversal and alternating motion with respect to the direction of advance of the slab, the improvement which consists of the steps of:

1) said chuck moving only in a direction perpendicular to the direction of advance of the slab;

2) advancing said slab on said conveyor belt in a discontinuous manner and while the slab is still, gauging a first band of said slab along the entire width thereof by causing the chuck and the tool carried thereon to perform a motion which is transversal to the direction of advance of the slab, wherein said tool has a width equal to the width of the slab and has an axis of rotation which is parallel or perpendicular to the direction of advance of said slab;

3) then halting said gauging and advancing the belt of a distance equal to the width of said slab and inverting the motion of the chuck, 4) gauging a second band of the slab parallel to said first band while the slab is still, whereby said chuck operates on a second band of said slab, said second band being parallel to said first band, and repeating said steps (1), (2) and (3) and (4) whereby said tool performs a fret-shaped path.

* * * * *